US009390880B2

(12) United States Patent
Jeong et al.

(10) Patent No.: US 9,390,880 B2
(45) Date of Patent: Jul. 12, 2016

(54) METHOD FOR DRIVING MULTI ELECTRIC FIELD EMISSION DEVICES AND MULTI ELECTRIC FIELD EMISSION SYSTEM

(71) Applicant: Electronics and Telecommunications Research Institute, Daejeon (KR)

(72) Inventors: Jin Woo Jeong, Daejeon (KR); Yoon-Ho Song, Daejeon (KR); Jun Tae Kang, Daegu (KR); Sungyoul Choi, Ulsan (KR); Jae-woo Kim, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 160 days.

(21) Appl. No.: 14/335,839

(22) Filed: Jul. 18, 2014

(65) Prior Publication Data

US 2015/0216025 A1 Jul. 30, 2015

(30) Foreign Application Priority Data

Jan. 24, 2014 (KR) ..... 10-2014-0009048

(51) Int. Cl.

| | |
|---|---|
| ***H05G 1/70*** | (2006.01) |
| ***H01J 29/98*** | (2006.01) |
| ***H01J 35/06*** | (2006.01) |

(52) U.S. Cl.

CPC ..... *H01J 29/98* (2013.01); *H01J 35/065* (2013.01); *H05G 1/70* (2013.01); *H01J 2235/068* (2013.01)

(58) Field of Classification Search

CPC ..... H05G 1/10; H05G 1/34; H05G 1/70; H05B 41/00; H05B 41/36

USPC ..... 378/92, 101, 109, 110, 114; 315/291, 315/307

See application file for complete search history.

(56) References Cited

U.S. PATENT DOCUMENTS 7,456,564 B2 11/2008 Song et al.
2013/0271037 A1 10/2013 Jeong et al.

FOREIGN PATENT DOCUMENTS

KR 10-0885188 B1 2/2009

*Primary Examiner* — Jurie Yun

(57) ABSTRACT

Provided is a method of driving multi electrical field emission devices. The method includes: respectively connecting first current control circuit devices for current path formation to a plurality of electric field emission devices; commonly connecting a second current control circuit device to the first current control circuit devices to commonly control the first current control circuit devices; and driving the first current control circuit devices at different timings when the second current control circuit device is driven.

20 Claims, 6 Drawing Sheets

METHOD FOR DRIVING MULTI ELECTRIC FIELD EMISSION DEVICES AND MULTI ELECTRIC FIELD EMISSION SYSTEM

CROSS-REFERENCE TO RELATED APPLICATIONS

This U.S. non-provisional patent application claims priority under 35 U.S.C. §119 to Korean Patent Application No. 10-2014-0009048, filed on Jan. 24, 2014, the entire contents of which are hereby incorporated by reference.

BACKGROUND OF THE INVENTION

The present invention disclosed herein relates to an electric field emission device such as an X-ray tube, and more particularly, to a method of more efficiently driving a plurality of electric field emission devices and a multi electric field emission system.

A tomosynthesis imaging system typically uses a plurality of electric field emission X-ray tubes.

An electric field emission device configuring an electric field emission X-ray tube includes a cathode where an emitter emitting electrons is formed. Once electric field is applied to the cathode of the electric field emission device, electrons are emitted from the emitter and are attracted to an anode. The electric field applied to the cathode is determined by a voltage of an anode in the case of a bipolar structure and by a gate voltage in the case of a tripolar structure.

In order for stable driving, a current flowing in an electric field emission device needs to be controlled to be constant. In order to control a current of an electric field emission device, a method of controlling a voltage applied to the electric field emission device is provided. However, the current of the electric field emission device is exponentially increased in correspondence to an applied voltage. Additionally, since the characteristic of the emitter of the electric field emission device may be deteriorated or activated as time elapses, a current emitted with respect to the same voltage may be decreased or increased. Accordingly, in general, it is difficult to constantly controlling an electric field emission current by using a voltage applied to an electric field emission device.

Accordingly, a technique of controlling an electric field emission current of an electric field emission device with a constant value by using a current control circuit is developed. That is, such a current control circuit directly controls a current flowing in a cathode of an electric field emission device by using a plurality of transistors connected in series to the cathode.

If a plurality of electric field emission X-ray tubes are configured using a plurality of electric field emission devices, at least two transistors are connected to each electric field emission device and each gate of the transistors is separately controlled. Therefore, a configuration of a current control circuit is complex and efficient driving is difficult.

SUMMARY OF THE INVENTION

The present invention provides a method of efficiently driving a plurality of electric field emission devices and a multi electric field emission system.

The present invention also provides a multi electric field emission system configuring a simple current control circuit driving a plurality of electric field emission devices.

Embodiments of the present invention provide methods of driving multi electrical field emission devices. The methods include: respectively connecting first current control circuit devices to form current path to a plurality of electric field emission devices; commonly connecting a second current control circuit device to the first current control circuit devices to commonly control the first current control circuit devices; and driving the first current control circuit devices at different timings while the second current control circuit device is driven.

In some embodiments, the plurality of electric field emission devices may form X-ray tubes, each having an anode and a cathode.

In other embodiments, the first current control circuit devices may be first power metal-oxide-semiconductor (MOS) field effect transistors (FETs) where a drain is connected to the cathode.

In still other embodiments, Pulse-width modulation (PWM) pulse signals having different widths may be respectively applied to gates of the first power MOSFETs.

In even other embodiments, the second current control circuit device may be one second power MOSFET in which a drain is commonly connected to a source of the first power MOSFET and a variable gate voltage is received by a gate.

In yet other embodiments, each time one of the first current control circuit devices is driven, the second current control circuit device may be driven first before the first current control circuit device is driven and then may be maintained during a driving time of the first current control circuit.

In further embodiments, each time one of the first current control circuit devices is driven, the second current control circuit device may be driven together in accordance with the driving of the first current control circuit device.

In still further embodiments, the plurality of electric field emission devices may be used for providing an image of a tomosynthesis imaging system.

In other embodiments of the present invention, multi electric field emission systems include: a multi electric field emission unit including a plurality of electric field emission devices; and a current control circuit controlling an electric field emission current of the multi electric field emission unit, wherein the current control circuit includes: a first current control driving unit including first current control transistors respectively connected to a plurality of electric field emission devices in order for separate current path formation; a second current control driving unit including a second current control transistor commonly connected to the first current control transistors; and control logics controlling the first current control transistors at different timings while the second current control driving unit is driven.

In some embodiments, when the second current control transistor is driven, one of the first current control transistors may be driven.

In other embodiments, after the second current control transistor is driven, at least one of the first current control transistors may be driven.

In still other embodiments, before the second current control transistor is driven, at least one of the first current control transistors may be driven.

In even other embodiments, the plurality of electric field emission devices may form X-ray tubes, each having an anode and a cathode.

In yet other embodiments, the first current control transistor may be a power MOSFET in which a drain is connected to the cathode.

In further embodiments, PWM pulse signals having different widths may be respectively applied to gates of the first power MOSFETs.

In still further embodiments, the second current control circuit device may be one second power MOSFET in which a drain is commonly connected to a source of the first power MOSFET and a variable gate voltage is received by a gate.

In still other embodiments of the present invention, methods of driving multi electric field emission devices include: respectively installing first current control circuit devices for current path formation to cathodes of a plurality of electric field emission devices; commonly installing a single second current control circuit device to the first current control circuit devices to commonly control the first current control circuit devices; and when at least one of the first current control circuit devices is driven while the second current control circuit device is driven, separately driving one selected for driving among the first current control circuit devices.

In some embodiments, before one of the first current control circuit devices is driven, the second current control circuit device may be driven in advance.

In other embodiments, when one of the first current control circuit devices is driven, the second current control circuit device may be driven simultaneously.

In still other embodiments, the driving of the first current control circuit devices may be performed by different trimming pulses.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings.

DETAILED DESCRIPTION OF PREFERRED EMBODIMENTS

Preferred embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art.

Hereinafter, it will be described about an exemplary embodiment of the present invention in conjunction with the accompanying drawings.

Figure 1:
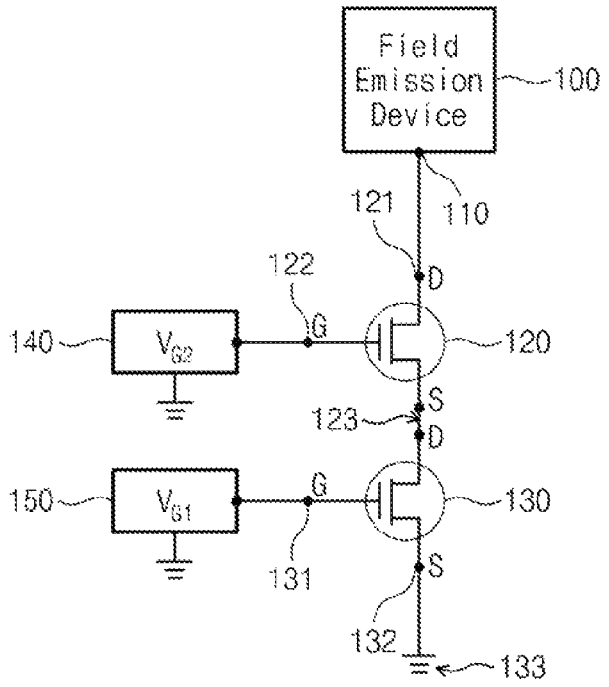
FIG. 1 (PRIOR ART)
FIG. 1 is a view illustrating a circuit configuration of an electric field emission system.

FIG. 1 is a circuit configuration of an electric field emission system.

Referring to FIG. 1, the electric field emission system includes an electric field emission device 100 and first and second current control transistors 120 and 130.

Figure 7:
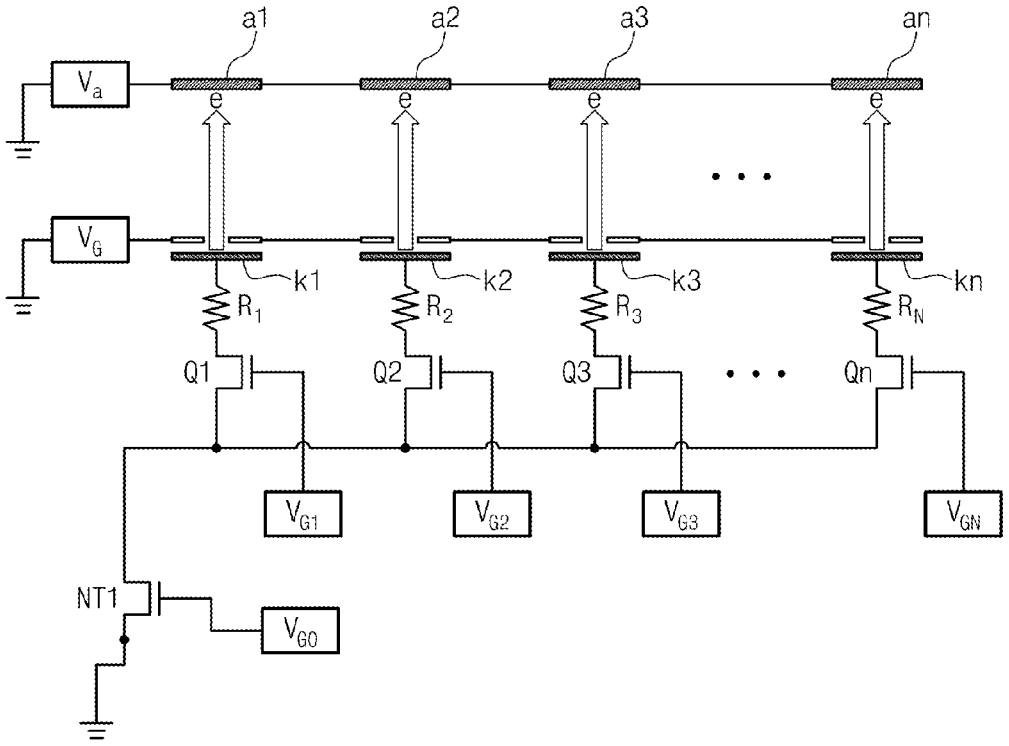
FIG. 7 is a circuit diagram of FIG. 4.

The electric field emission device 100 includes a cathode 110 for emitting electrons. An applied voltage Va for generating an electric field may be provided to the electric field emission device 100 as shown in FIG. 7. In the electric field emission device 100 having a bipolar structure, the applied voltage Va may be applied to an anode. Moreover, in the electric field emission device 100 having a tripolar structure, the applied voltage Va may be applied to a gate.

The cathode of the electric field emission device 100 may include an emitter for emitting electrons shown in FIG. 7. If more than a predetermined voltage different between an anode and emitter or between a gate and an emitter occurs, electrons are emitted from the emitter of the cathode through tunneling. A voltage difference between an applied voltage and a cathode voltage, which is required for emitting electrons from a cathode, is defined as an electric field emission voltage Vac.

As the drain 121 is connected to the cathode 110 of the electric field emission device 100, the first current control transistor 120 controls an electric field emission current of the electric field emission device. Here, the first current control transistor 120 may be a metal-oxide-semiconductor field-effect transistor (MOSFET).

Referring to FIG. 1, a gate voltage VG2 is applied to the gate 122 of the first current control transistor 120. The drain-source current of the first current control transistor 120 may be controlled by the gate voltage VG2. A current that is the same as the drain-source current of the first current control transistor 120 needs to flow in the electric field emission device 100 connected in series to the first current control transistor 120. Accordingly, when the drain-source current is controlled by the first current control transistor 120, in response to this, the potential of the cathode voltage of the electric field emission device 100 is changed so that an electric field emission current may be controlled.

In the second current control transistor 130, the drain is connected to the source 123 of the first current control transistor 120. Here, the second current control transistor 130 may be a MOSFET.

Referring to FIG. 1, a gate voltage VG1 is applied to the gate 131 of the second current control transistor 130. The drain-source current of the second current control transistor 130 may be controlled by the gate voltage VG1.

First and second control logics 140 and 150 controls each gate voltage of the first and second current control transistors 120 and 130. The first control logic 140 may adjust or limit the current level of an electric field emission current by using the first current control transistor 120. Additionally, the second control logic 140 may maintain an electric field emission current constantly by using the first and second current control transistors 120 and 130 together. At this point, the applied voltage Va applied to the electric field emission device 100 is required to have a sufficiently high value allowing more than a desired current level of current to be emitted.

The first control logic 140 provides a first gate voltage VG2 to the gate of the first current control transistor 120. The second control logic 150 provides a second gate voltage VG1 to the gate of the second current control transistor 130.

The first and second control logics 140 and 150 may control the electric field emission current amount of the electric field emission device 100 by using the first gate voltage VG2. Additionally, the first and second control logics 140 and 150 may control the drain node threshold of the first current control transistor 120 by using the second gate voltage VG1.

In such a way, since the electric field emission system uses a plurality of transistors connected in series to the electric field emission device, even when the electric field emission current function is changed, an electric field emission current may be maintained constantly. Moreover, the electric field emission system may adjust an electric field emission current level to a desired current level by using a current control circuit including a plurality of transistors.

Figure 2:
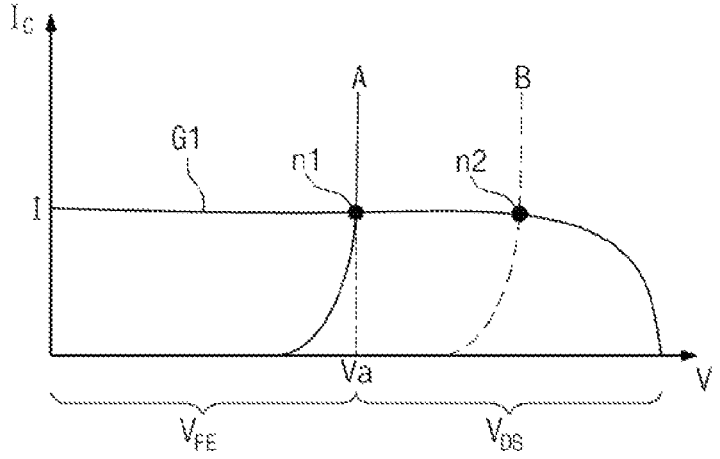
FIG. 2 (PRIOR ART)
FIG. 2 is a graph illustrating an operational characteristic of the circuit of FIG. 1.

FIG. 2 is a graph illustrating an operational characteristic of the circuit of FIG. 1.

In FIG. 2, an x-axis represents voltage and a y-axis represents current.

An initial electric field emission current characteristic of the electric field emission device 100 of FIG. 1 is shown as a graph A intersecting a graph G1 and a node n1 in a voltage interval. That is, the initial electric field emission current characteristic is increased exponentially when the electric field emission voltage Vac is greater than a predetermined level of threshold voltage.

While the gate voltages VG2 and VG1 are applied constantly, a drain-source current Ids according to a combination of the first and second current control transistors 120 and 130 with respect to the electric field emission voltage Vac is shown in FIG. 2. The saturation current Isat of the drain-source current Ids is determined based on the gate voltages VG2 and VG1.

Since the first and second current control transistors 120 and 130 are connected in series with respect to the electric field emission device 100, the initial electric field emission current and the drain-source current Ids are required to have the same value. Accordingly, the electric field emission current of the electric field emission device 100 becomes the saturation current Isat of the drain-source current Ids.

If the emitter of the electric field emission device 100 is deteriorated, an electric field emission current function with respect to the electric field emission voltage Vac is changed, the deterioration electric field emission current characteristic may be shown as a graph B in an interval VDS. However, due to a saturation characteristic formed by a combination of the first and second current control transistors 120 and 130, the deterioration electric field emission current has the saturation current Isat of the drain-source current Ids.

Accordingly, the electric field emission system of FIG. 1 may maintain an electric field emission current constantly in spite of the deterioration of the electric field emission device 100.

As a result, even when the electric field emission characteristic changes from the graph A to the graph B, due to a saturation characteristic formed by a combination of the first and second current control transistors 120 and 130, the electric field emission current may be limited to the same current I as shown in a graph G1.

Figure 3:
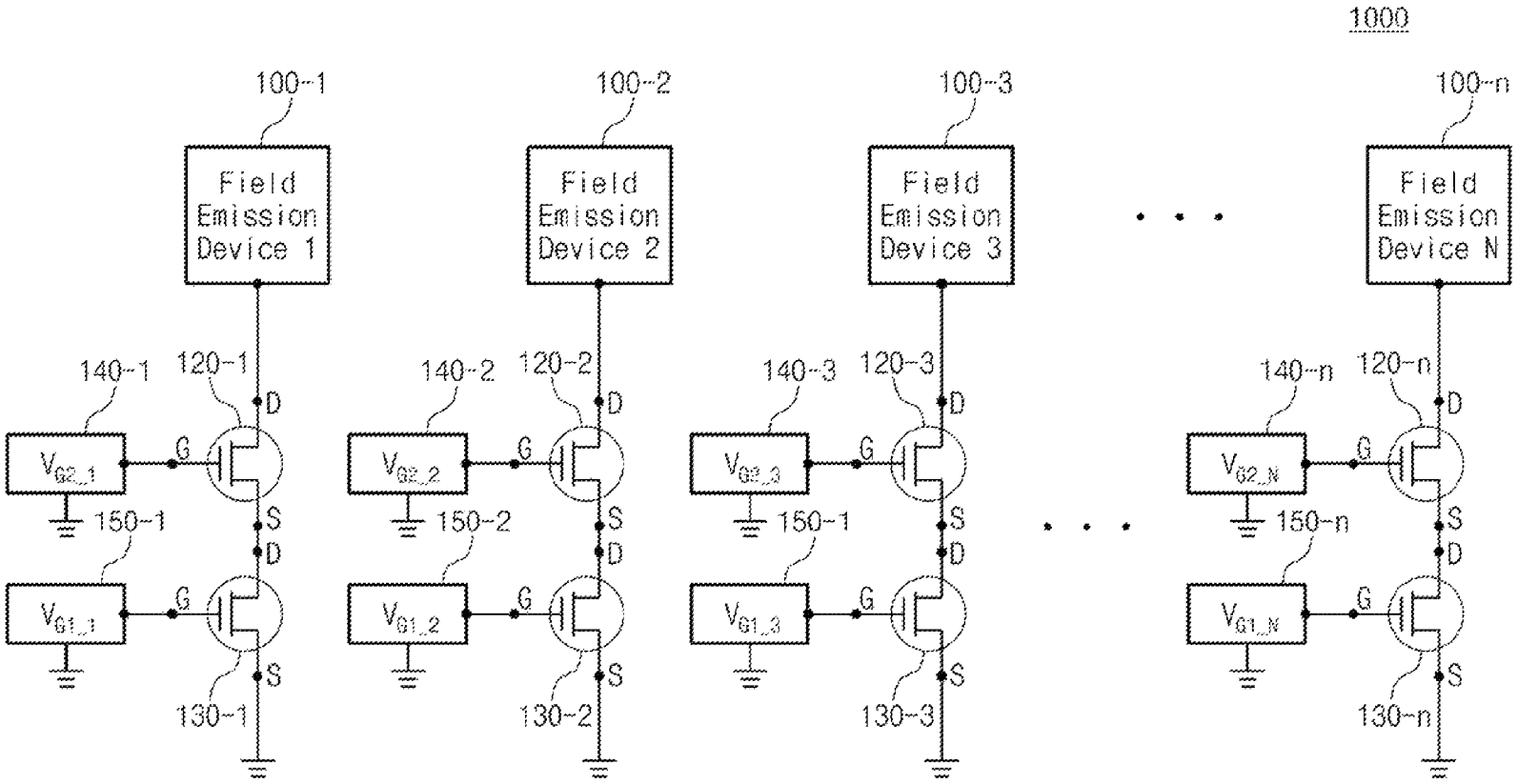
FIG. 3 (PRIOR ART)
FIG. 3 is a view illustrating a configuration of a multi electric field emission system.

FIG. 3 is a view illustrating a configuration of a multi electric field emission system.

FIG. 3 illustrating a plurality of electric field emission systems using the electric field emission system of FIG. 1 as a unit configuration. That is, when a tomosynthesis imaging system is configured, a plurality of electric field emission X-ray tubes may be installed. In such a case, an electric field emission system shown in FIG. 1 is required to be configured at each X-ray tube. Accordingly, in order to driving one electric field emission device, at least two transistors are connected in series and each transistor needs to be controlled separately.

Accordingly, a circuit configuration of an entire system 1000 becomes complex and in terms of the drive control, a control logic needs to be installed at each unit electric field emission system and controlled separately. That is, this is inefficient.

Figure 4:
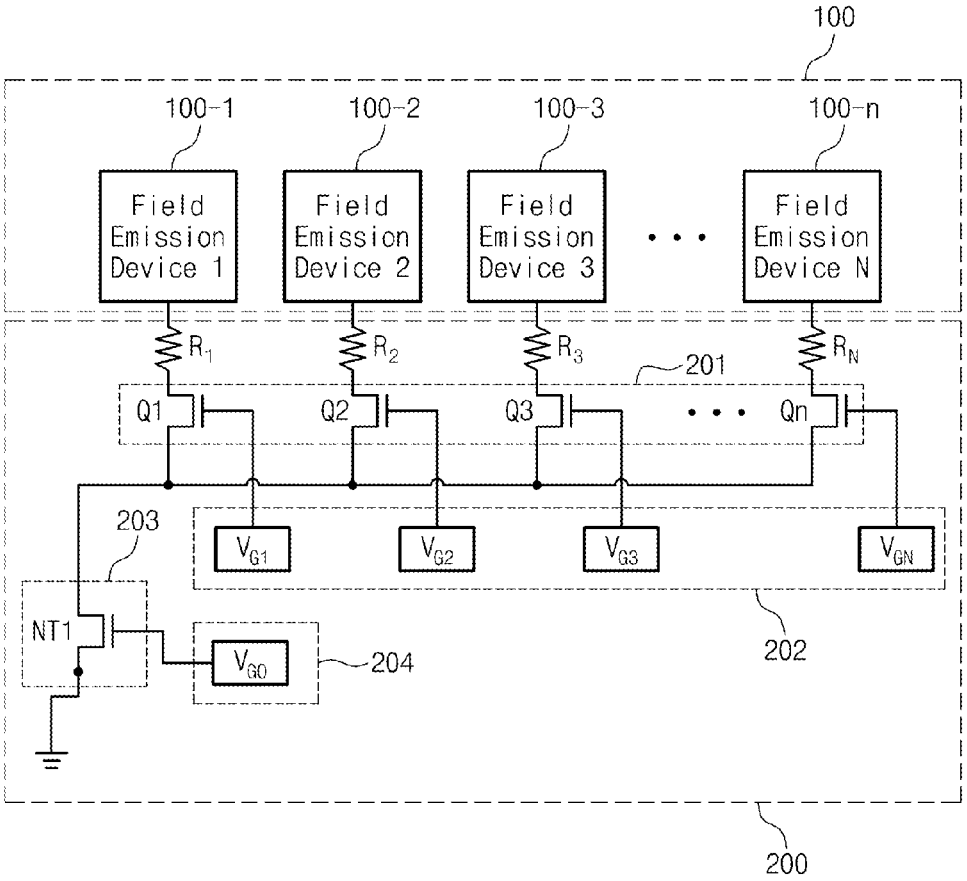
FIG. 4 is a view illustrating a configuration of a multi electric field emission system according to an embodiment of the present invention.

According to an embodiment of the present invention, in order to resolve the issues in FIG. 3, a multi electric field emission system of FIG. 4 is prepared.

In the case of the present invention, in consideration that X-ray tubes implemented in a multi electric field emission system do not operate simultaneously, a structure using a second current control circuit device commonly is suggested. The second current control circuit device may be implemented using a second current control transistor.

FIG. 4 is a view illustrating a configuration of a multi electric field emission system according to an embodiment of the present invention.

Referring to FIG. 4, the multi electric field emission system includes a multi electric field emission unit 100 including a plurality of electric field emission devices 100-1 to **100-*n* and a current control circuit 200 controlling an electric field emission current of the multi electric field emission unit 100**.

The current control circuit 200 includes a first current control driving unit 201 including first current control transistors Q1 to Qn respectively connected to the plurality of electric field emission devices 100-1 to **100-*n* in order for separate current path formation and a second current control driving unit 203 including a second current control transistor NT1 commonly connected to the first current control transistors Q1** to Qn.

Additionally, the current control circuit 200 includes control logics 202 and 204 controlling the first current control transistors Q1 to Qn at different timings while the second current control driving unit 203 is driven.

When the second current control transistor NT1 is driven, one of the first current control transistors Q1 to Qn may be driven.

After the second current control transistor NT1 is driven, at least one of the first current control transistors Q1 to Qn may be driven.

Before the second current control transistor NT1 is driven, at least one of the first current control transistors Q1 to Qn may be driven.

The plurality of electric field emission devices 100-1 to **100-*n*** may form X-ray tubes each having an anode and a cathode.

The first current controls transistors and the second current control transistor NT1 may be a power MOSFET.

Especially, the first current control transistors may be a depletion or enhanced mode metal oxide layer semiconductor electric field effect transistor. However, the first and second current transistors of the present invention are not limited thereto.

Although two transistors including the first current control transistor Q1 and the second current control transistor NT1 per one electric field emission device are shown in FIG. 4, the number of current control transistors included in the current control circuit 200 is not limited. For example, the current control circuit 200 may include at least three current control transistors connected in series to each other.

In FIG. 4, it is shown that the second current control driving unit 203 is configured with a single second current control transistor NT1. In such a way, by using the second current control transistor NT1 as a common driving device, the sources of the first current control transistors Q1 to Qn respectively connected to a plurality of electric field emission devices are controlled at different timings. That is, the first current control transistors Q1 to Qn may be driven one at a time.

In such a way, an electric field emission current is limited so that a system is controlled constantly.

Here, the meaning of 'constantly' includes the meaning that an electric field emission current is constant over time even if an electric field characteristic changes and the meaning that even if the characteristics of a plurality of electric field emission devices are different, an electric field emission current is controlled to be constant.

Moreover, as shown in FIG. 4, protective resistors R1 to Rn may be connected in series between each drain of the first current control transistors Q1 to Qn and each cathode of the electric field emission devices 100-1 to 100*n*.

As a result, if the sources of the first current control transistors Q1 to Qn are bound as one and commonly controlled through one transistor NT1, the current of each electric field emission device is controlled to be constant and of course, a simple circuit configuration is realized and control efficiency is improved.

In order to turn on a transistor one at a time, a gate voltage is applied to the gate of the first current control transistors Q1 to Qn at different timings. Each time a voltage is applied to the gates of the first current control transistors Q1 to Qn, a voltage in a pulse form may be applied to the gate of the second current control transistor NT1. The gate voltage may be provided as a variable gate voltage level. This will be described in more detail with reference to FIG. 6.

According to FIG. 4, the disadvantage of FIG. 3 that at least two transistors are connected in series for each one electric field emission device and thus each transistor needs to be controlled separately may be overcome. Accordingly, an entire circuit configuration of a multi electric field emission system becomes simple. Additionally, in terms of the drive control, since it is unnecessary that a control logic is installed at each unit electric field emission system and each needs to be controlled separately, control efficiency is improved.

Figure 5:
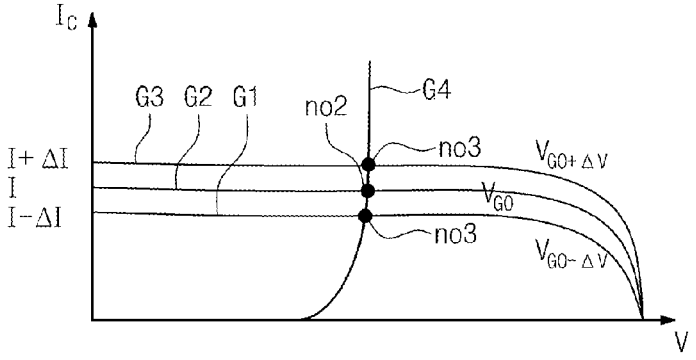
FIG. 5 is a graph illustrating an operational characteristic of the circuit of FIG. 4.

FIG. 5 is a graph illustrating an operational characteristic of the circuit of FIG. 4.

In FIG. 5, an x-axis represents voltage and a y-axis represents current. In the drawing, an electric field emission current characteristic is shown as a graph G4 and a characteristic change according to an initial state and a deterioration state of an electric field emission device is identical to that described with reference to FIG. 2.

Since the first and second current control transistors Q1 and NT1 are connected in series with respect to the electric field emission device 100-1, an electric field emission current and the drain-source currents Ids1 and Ids2 of the first and second current control transistors Q1 and NT1 are required to have the same value.

In the case of FIG. 5, an electric field current characteristic is increased exponentially as shown in the graph G4 when the electric field emission voltage Vac becomes more than a predetermined level of threshold voltage.

A graph G2 intersecting the graph G4 through a node no2 shows an electric field emission current I obtained by a saturation characteristic when a gate voltage VGC is applied to the gate of the second current control transistor NT1.

A graph G3 intersecting the graph G4 through a node no3 shows an electric field emission current I+ΔI obtained by a saturation characteristic when a gate voltage VGC+ΔV is applied to the gate of the second current control transistor NT1.

A graph G1 intersecting the graph G4 through a node no1 shows an electric field emission current I−ΔI obtained by a saturation characteristic when a gate voltage VGC−ΔV is applied to the gate of the second current control transistor NT1.

As a result, due to a saturation operational characteristic of two series-connected transistors, even when a cathode voltage is changed by the deterioration of an electric field emission device, an electric field emission current is maintained with a predetermined value by the system of FIG. 4.

In such a way, through the graph characteristic of FIG. 5, even if an electric field emission characteristic is changed, an electric field emission current is limited to the same current value as shown in the graphs G1, G2 and G3 by operations of the first and second current control transistors.

Figure 6:
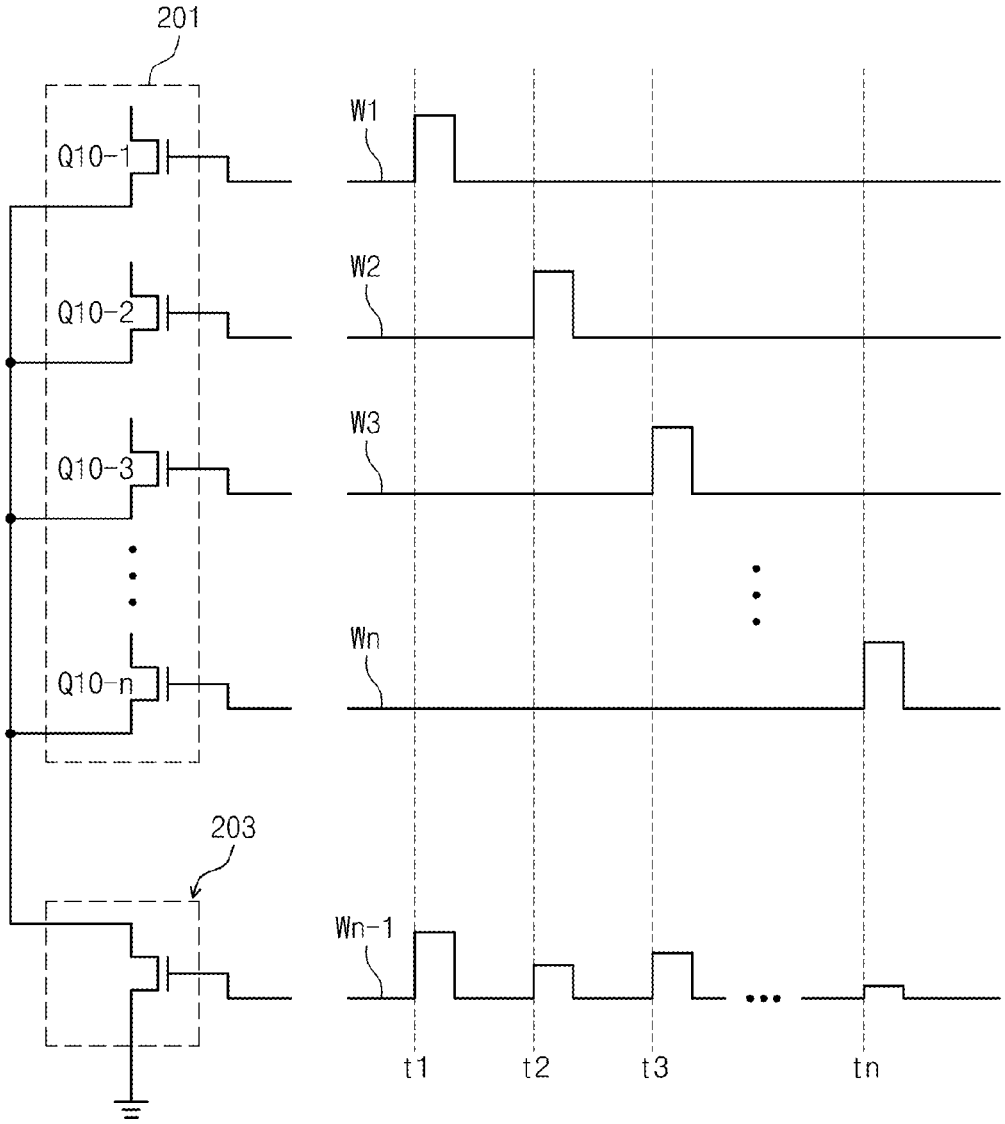
FIG. 6 is a drive timing diagram according to FIG. 4.

FIG. 6 is a view illustrating a drive timing according to FIG. 4.

Referring to FIG. 6, a first current control driving unit 201 that includes correspondingly connected first current control transistors Q10-1 to Q10-*n* in order for forming a separate current path in a plurality of electric field emission devices is shown.

Additionally, a second current control driving unit 203 including the second current control transistor NT1 that is commonly connected to the first current control transistors Q10-1 to Q10-*n* is shown.

For example, when the first current control transistor Q10-1 among the first current control transistors Q10-1 to Q10-*n* is driven, a pulse voltage displayed as a waveform W1 is applied to the gate of the first current control transistor Q10-1. At this point, a pulse voltage displayed as a waveform Wn is applied to the gate of the second current control transistor NT1.

Referring to FIG. 6, a gate voltage applied to the gate of the second current control transistor NT1 may be a variable gate voltage in different voltage levels. For example, since a gate voltage applied at a time t1 is higher than a gate voltage applied at a time t2, the drain-source current of the second current control transistor NT1 may be relatively greatly controlled at the time t1.

Here, a turn on operation of the first current control transistor Q10-1 and a turn on operation of the second current control transistor NT1 may be performed simultaneously at the time t1. However, this is just an embodiment. For example, after the second current control transistor NT1 is turned on, the first current control transistor Q10-1 may be turned on and vice versa.

In such a way, adjusting a turn on operation interval of the first current control transistor Q10-1 and a turn on operation interval of the second current control transistor NT1 is meaningful in terms of reducing the consumption of a peak current. However, for example, even if the first current control transistor Q10-1 after the second current control transistor NT1 is turned on, a turn on operation of the second current control transistor NT1 needs to be maintained until the first current control transistor Q10-1 is turned off.

Moreover, when the first current control transistor Q10-*n* among the first current control transistors Q10-1 to Q10-*n* is driven, a pulse voltage displayed as a waveform W4 is applied to the gate of the first current control transistor Q10-*n* at a time tn. At this point, a pulse voltage displayed as a waveform Wn is applied to the gate of the second current control transistor NT1 at the time tn. Here, a turn on operation of the first current control transistor Q10-*n* and a turn on operation of the second current control transistor NT1 may be performed simultaneously at the time tn. However, this is just an embodiment. For example, after the second current control transistor NT1 is turned on, the first current control transistor Q10-10 may be turned on and vice versa.

Although the first current control transistors Q10-1 to Q10-*n* are sequentially driven in FIG. 6, by changing a pulse timing applied as a gate voltage, the first current control transistors Q10-1 to Q10-*n* may be non-sequentially driven.

In accordance with a time at which a gate pulse is applied to a transistor to be driven among the first current control transistors Q10-1 to Q10-*n*, a gate pulse allowing a current of a corresponding electric field emission device to be emitted by a set current is applied to the gate of the second current control transistor NT1. Here, a duty of a gate pulse may be controlled by a set duty value and a gate pulse width applied to the first and second current transistors may vary. Additionally, a gate voltage may be provided a variable gate voltage in different levels in order to separately control a drive of a drain-source current of a current control transistor.

FIG. 7 is a view illustrating a circuit diagram of FIG. 4.

Referring to FIG. 7, a configuration of controlling a tripolar electric field emission device is shown. The electrodes of each electric field emission device, for example, an anode a1 and a gate, are respectively connected to the voltage sources Va and Vg. An electric field emission current of each electric field emission device is controlled by the current control circuit 200 of FIG. 4 connected to the cathode.

If one electric field emission device is deteriorated, an electric field current function with respect to the electric field emission voltage Vac is changed so that the cathode voltage Vc of the electric field emission device may be changed. However, by a saturation characteristic of first and second current control transistors (for example, Q1 and NT1), an electric field emission current may be maintained with a predetermined value Istd limited by the first current control transistor Q1.

As a result, an operation of the current control circuit 200 of FIG. 7 is identical to that of the current control circuit of FIG. 4. Accordingly, the electric field emission current characteristic described with reference to FIG. 5 is provided.

Figure 8:
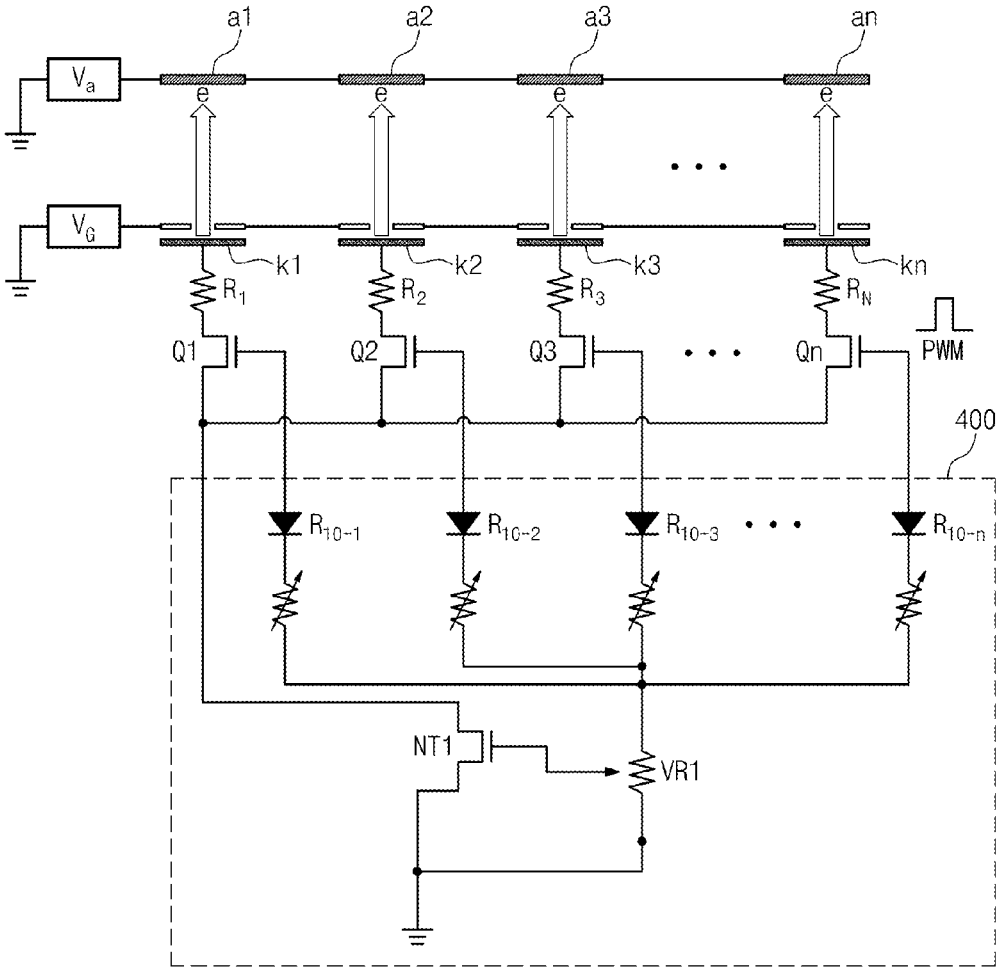
FIG. 8 is a modified circuit diagram of FIG. 7.

FIG. 8 is view illustrating a modified circuit diagram of FIG. 7.

In the case of FIG. 8, the control logic 202 of FIG. 4 includes a trimming circuit 400.

That is, a set gate pulse is applied to each gate of the first current control transistors Q1 to Qn at different timings. In this case, the voltage of the gate pulse may be about 5 V. In this case, a voltage set to the gate of the first current control transistor Q1 becomes a voltage obtained by dividing 5 V by a serial composite resistance value of a first trimming resistor R10-1 and a second trimming resistor VR1. The reason that a diode is connected to the front end of the first trimming resistor R10-1 is that when the first current control transistor Q1 is turned on, other current control transistors are not to be affected by voltage.

As a result, by appropriately adjusting trimming resistors through the trimming circuit 400, a current control may vary for each electric field emission device.

In such a way, according to an embodiment of the present invention, even if an emitter characteristic of an electric field emission device is changed, the same current characteristic may be obtained.

According to a configuration of the present invention, a relatively simple circuit may drive a plurality of electric field emission devices. Since it is unnecessary that at least two transistors are connected to one electric field emission device and each transistor needs to be controlled separately, an entire circuit configuration of a multi electric field emission system becomes simple. Additionally, in terms of the drive control, since it is unnecessary that a control logic is installed at each unit electric field emission system and each needs to be controlled separately, control efficiency is improved.

The above-disclosed subject matter is to be considered illustrative, and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A method of driving multi electrical field emission devices, the method comprising:

respectively connecting first current control circuit devices to form current path to a plurality of electric field emission devices;

commonly connecting a second current control circuit device to the first current control circuit devices to commonly control the first current control circuit devices; and driving the first current control circuit devices at different timings while the second current control circuit device is driven.

2. The method of claim 1, wherein the plurality of electric field emission devices form X-ray tubes, each having an anode and a cathode.

3. The method of claim 2, wherein the first current control circuit devices are first power metal-oxide-semiconductor (MOS) field effect transistors (FETs) where a drain is connected to the cathode.

4. The method of claim 3, wherein Pulse-width modulation (PWM) pulse signals having different widths are respectively applied to gates of the first power MOSFETs.

5. The method of claim 3, wherein the second current control circuit device is one second power MOSFET in which a drain is commonly connected to a source of the first power MOSFET and a variable gate voltage is received by a gate.

6. The method of claim 1, wherein each time one of the first current control circuit devices is driven, the second current control circuit device is driven first before the first current control circuit device is driven and then is maintained during a driving time of the first current control circuit device.

7. The method of claim 1, wherein each time one of the first current control circuit devices is driven, the second current control circuit device is driven together in accordance with the driving of the first current control circuit device.

8. The method of claim 1, wherein the plurality of electric field emission devices are used for providing an image for a tomosynthesis imaging system.

9. A multi electric field emission system comprising:

a multi electric field emission unit including a plurality of electric field emission devices; and a current control circuit controlling an electric field emission current of the multi electric field emission unit, wherein the current control circuit comprises:

a first current control driving unit including first current control transistors respectively connected to the plurality of electric field emission devices in order to form separate current path;

a second current control driving unit including a second current control transistor commonly connected to the first current control transistors; and control logics controlling the first current control transistors at different timings while the second current control driving unit is driven.

10. The system of claim 9, wherein when the second current control transistor is driven, one of the first current control transistors is driven.

11. The system of claim 9, wherein after the second current control transistor is driven, at least one of the first current control transistors is driven.

12. The system of claim 9, wherein before the second current control transistor is driven, at least one of the first current control transistors is driven.

13. The system of claim 9, wherein the plurality of electric field emission devices form X-ray tubes, each having an anode and a cathode.

14. The system of claim 13, wherein the first current control transistors are first power MOSFETS in which a drain is connected to the cathode.

15. The system of claim 14, wherein PWM pulse signals having different widths are respectively applied to gates of the first power MOSFETs.

16. The system of claim 14, wherein the second current control transistor is one second power MOSFET in which a drain is commonly connected to a source of the first power MOSFET and a variable gate voltage is received by a gate.

17. A method of driving multi electric field emission devices, the method comprising:

respectively installing first current control circuit devices for current path formation to cathodes of a plurality of electric field emission devices;

commonly installing a single second current control circuit device to the first current control circuit devices to commonly control the first current control circuit devices; and when at least one of the first current control circuit devices is driven while the second current control circuit device is driven, separately driving one selected for driving among the first current control circuit devices.

18. The method of claim 17, wherein before one of the first current control circuit devices is driven, the second current control circuit device is driven in advance.

19. The method of claim 17, wherein when one of the first current control circuit devices is driven, the second current control circuit device is driven simultaneously.

20. The method of claim 19, wherein the driving of the first current control circuit device is performed by different trimming pulses.

* * * * *